United States Patent [19]

Gutridge et al.

[11] 4,134,233

[45] Jan. 16, 1979

[54] SLIDING DOOR FOR RAILWAY PASSENGER CAR COMPARTMENT

[75] Inventors: Jack E. Gutridge, Dyer; Walter J. Marulic, Gary, both of Ind.

[73] Assignee: Pullman Incorporated, Chicago, Ill.

[21] Appl. No.: 861,920

[22] Filed: Dec. 19, 1977

[51] Int. Cl.[2] ..... E05D 13/02

[52] U.S. Cl. ..... 49/411; 49/460; 49/501

[58] Field of Search ..... 49/409, 411, 501, 62, 49/460, 410; 105/315, 314; 52/627, 613

[56] References Cited

U.S. PATENT DOCUMENTS

| | | | |
|---|---|---|---|
| 245,085 | 8/1881 | McGrady | 105/315 |
| 1,270,011 | 6/1918 | Conwell | 49/411 |
| 2,121,714 | 6/1938 | Rose | 49/460 X |
| 2,546,134 | 3/1951 | Watter | 105/315 |
| 2,724,347 | 11/1955 | Watter | 105/315 |
| 2,970,642 | 2/1961 | Parsons | 49/411 X |
| 2,980,969 | 4/1961 | Tinfow | 49/411 |
| 3,615,144 | 10/1971 | Plemeng | 49/411 |
| 3,780,472 | 12/1973 | Biebuyck | 49/501 |
| 3,906,669 | 9/1975 | Vorguitch | 49/62 X |
| 3,990,185 | 11/1976 | Nagase | 49/501 |

*Primary Examiner*—Philip C. Kannan
*Attorney, Agent, or Firm*—Thomas G. Anderson

[57] ABSTRACT

A sliding door for a railway passenger car compartment includes structural panel support members of extruded material facilitating the assembly and replacement of parts and providing a construction which will support accessory portions of the door without the need of special fastening devices.

13 Claims, 9 Drawing Figures

FIG. 1
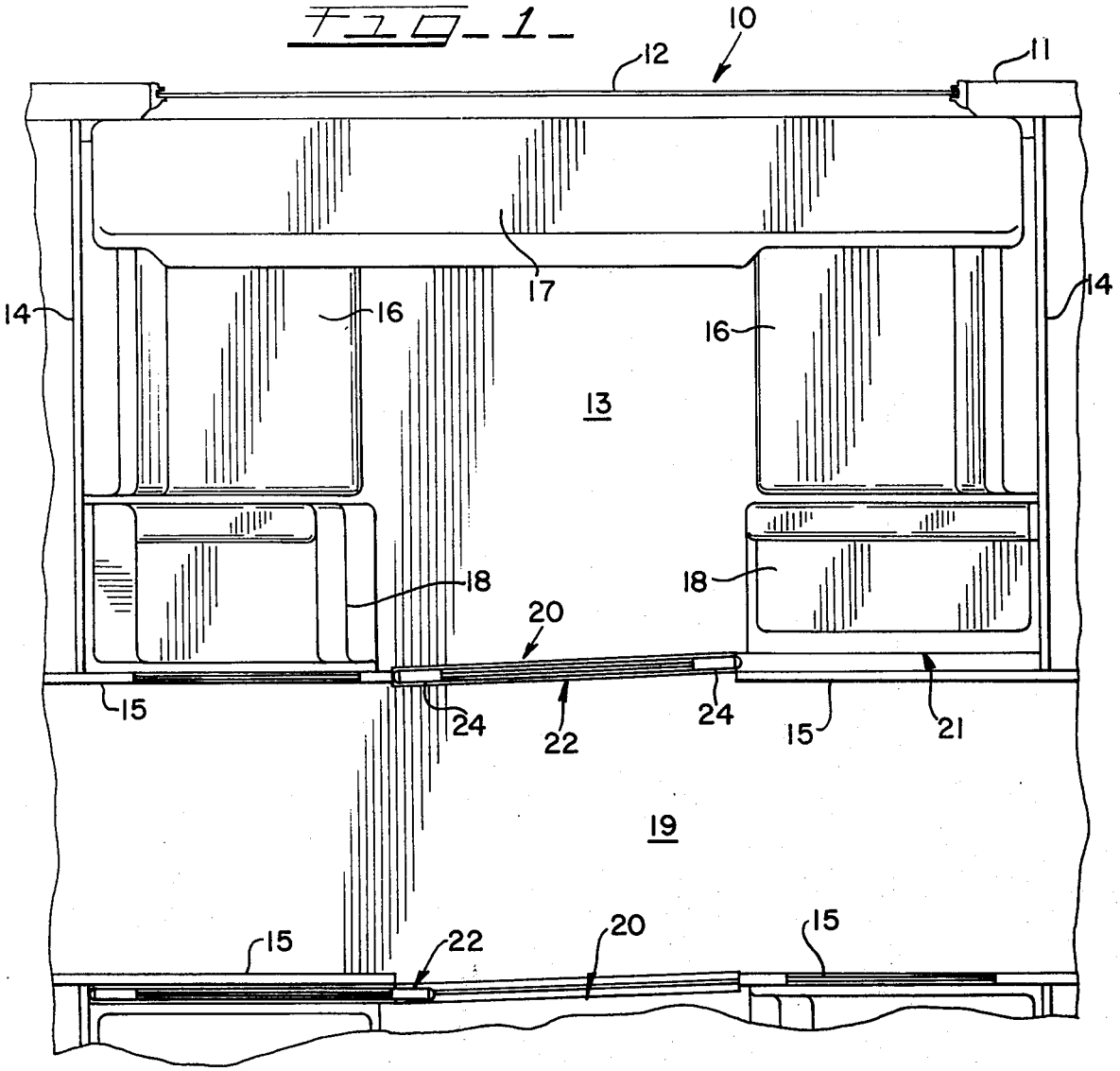
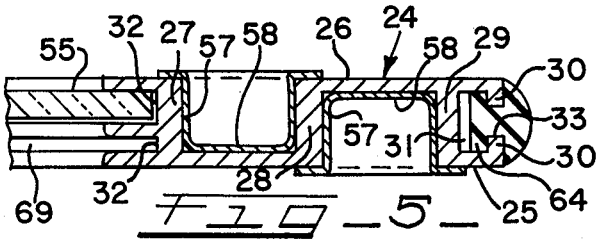
FIG. 5
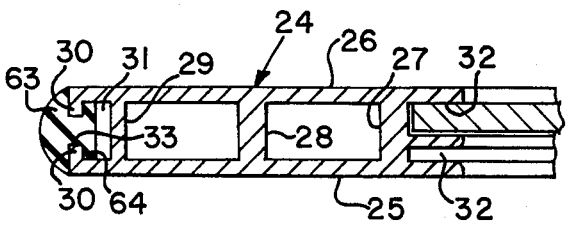
FIG. 4
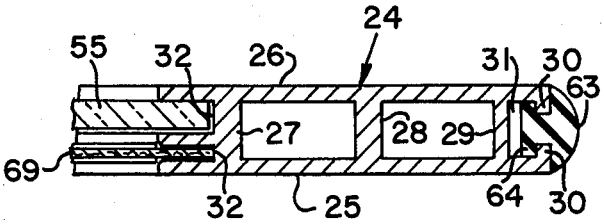
FIG. 6

SLIDING DOOR FOR RAILWAY PASSENGER CAR COMPARTMENT

BACKGROUND OF THE INVENTION

1. Field of the Invention

The present invention relates to sliding doors and more particularly to a door specially suited for a railway passenger car compartment.

2. Description of the Prior Art

The prior art pertinent to the present invention includes U.S. Pat. Nos. 111,468, Jan. 31, 1871; 245,085, Aug. 2, 1881; 1,939,312, Dec. 12, 1933; 1,971,098, Aug. 21, 1934; 2,531,687, Nov. 28, 1950; 2,546,134, Mar. 20, 1951; and 2,561,079, July 17, 1951.

SUMMARY OF THE INVENTION

The present invention relates to a sliding door particularly well suited for railway passenger car compartments which is constructed particularly of extruded materials such as extruded aluminum. The construction includes laterally spaced end frame members of hollow extruded construction having internally positioned walls therein and which include at opposite outer edges thereof indentations or recesses extending the length of the end members. Each recess is defined by an inwardly extending end cavity which provides a narrow slot which opens into an enlarged recess, thereby defining a total recess of T-shaped configuration. The outer recesses of the vertical end members may have supported therein suitable rubber nose strips having a T-shaped configuration and being made of an elastic material so that the nose strips can be inserted into the T-shaped recesses and locked into place without the utilization of additional fasteners. The inside edge recesses of the end members are suitably aligned to provide for the mounting of the panels, windows, etc., as is more fully described below. The sliding door construction also includes upper and lower horizontal members of similar extruded construction which are connected by means of removable fasteners to the end members to provide a door having a strong and rigid frame which is easily assembled and disassembled by means of screw-type fasteners. The upper and lower horizontal members are of identical hollow extruded shape as the end members, including internally extending walls and are provided at the outer portions thereof with similar T-shaped recesses as are present in the vertical end members. The extruded frame of the sliding door is completed by a plurality of vertically spaced intermediate members of extruded shape having upper and lower recesses which, in the assembled condition of the door, position and contain horizontal edges of transparent and solid panels, the vertical edges of which are positioned and contained by the inside edge recesses of the vertical end members of the door. The vertical end members of the door are releasably connected by means of screws to both the upper and lower horizontal members, and the intermediate frame members so that the door can be quickly and easily assembled and disassembled for replacement of the panels as desired. The T-shaped recess of the upper horizontal member has contained therein hangers, having a T-shaped lower configuration, on which are mounted rollers, the rollers being supported by tracks which are secured to the upper header member of the compartment above the door, and which permit the sliding movement of the door between open and closed positions. The lower horizontal member has a similar recess of T-shaped configuration which provides guide surfaces contacting an inverted T-shaped guide member which is supported on the floor. The particular shape of the T-shaped recess of the lower horizontal member permits the guidance of the door without the problem of debris and other material becoming lodged between the guide and the recess so as to impede the operation of the door. The configuration of the inside edge recesses provided on the inner edges of the vertical end members, as well as on the inside edges of the upper and lower horizontal members is such that a vent panel, a transparent panel, and a solid panel are contained therein. The recesses on the inner portions of the aforementioned members also include recesses which contain a shade in sliding relation to the door which may be moved upwardly from a lower position to cover the transparent panel window of the sliding door.

BRIEF DESCRIPTION OF THE DRAWINGS

FIG. 1 is a schematic plan view of a passenger car compartment adjacent to an elongated aisle;

FIG. 4 is a cross-sectional view taken along the line 4—4 of FIG. 2;

FIG. 5 is a cross-sectional view taken along the line 5—5 of FIG. 2;

FIG. 6 is a cross-sectional view taken along the line 6—6 of FIG. 2;

DESCRIPTION OF THE PREFERRED EMBODIMENT

Figure 2:
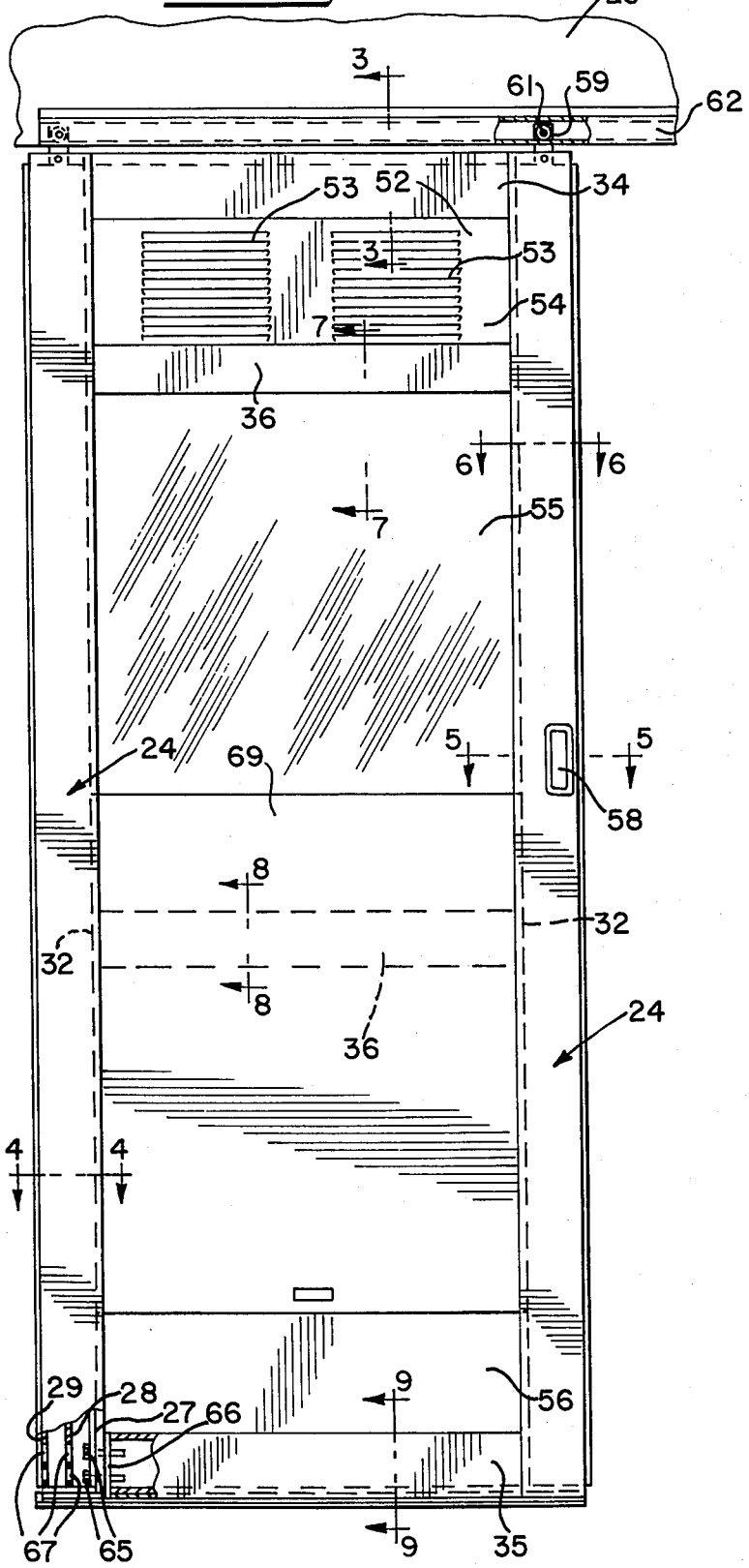
FIG. 2 is a front elevational view of a sliding door connected to a header member of a passenger car compartment.

Referring now particularly to FIG. 1, a railway passenger car compartment 10 comprises a car side 11 a side window 12 and a floor structure 13. As shown in FIG. 1, the compartments are positioned on the opposite sides of an aisle 19 and each includes transversely extending partition walls 14 connected suitably to longitudinally extending divider walls 15. The compartment 10 includes convertible seats 16, an upper berth 17, and combination units of an arm rest, ladder and storage compartment designated at 18. The divider walls 15 are spaced longitudinally to provide an access opening 20. One of the combination units 18 is suitably spaced from one of the divider walls 15 to provide a storage space designated at 21, which is used when the door is moved to allow passage through access opening 20.

A door is generally designated at 22 and is supported on a header member 23 above the door opening 20, header 23 being suitably connected to the upper ends of the divider walls 15. The door 22 includes a frame comprising a pair of horizontally spaced hollow vertical end members 24 each containing a front side wall 25 and a rear side wall 26. The end members 24 are preferably constructed of extruded aluminum and include a plurality of vertical internally extending first inner, intermediate and outer transverse walls 27, 28, and 29 integrally formed with the front and rear walls 25 and 26. As best shown in FIGS. 4 and 6, the hollow vertical end members 24 include outer edge wall portions 30 in spaced relation to define elongated access slots 33 which communicate with first outermost recesses 31 to define a generally T-shaped recess. The inside edges of each of the end members 24 are also provided with adjacent second recesses designated at 32.

Figure 3:
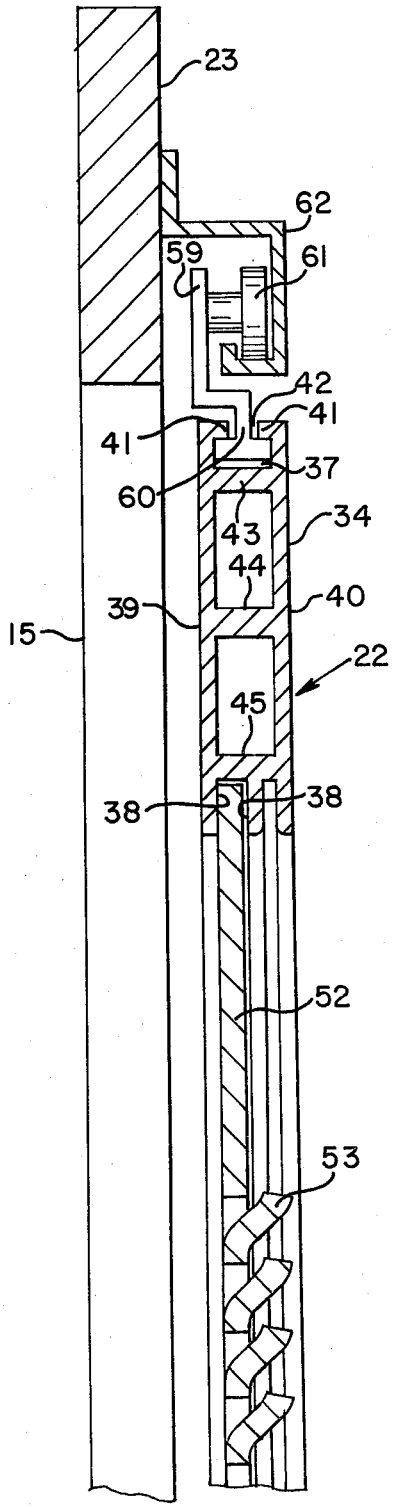
FIG. 3 is a cross-sectional view taken along the line 3—3 of FIG. 2.
Figure 9:
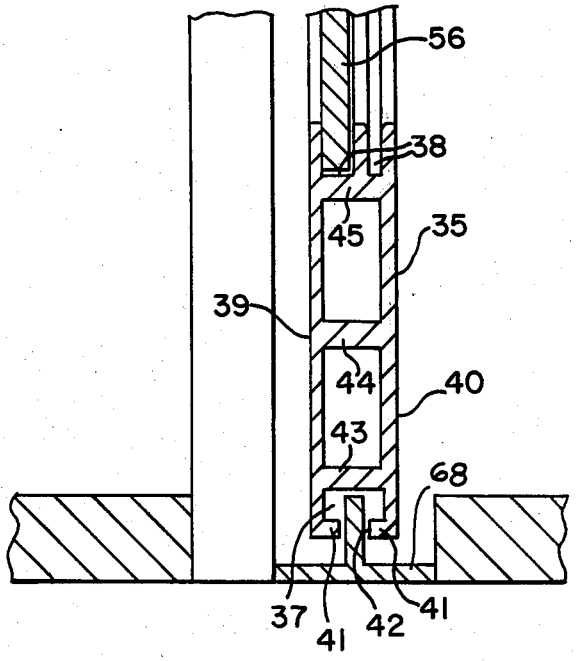
FIG. 9 is a cross-sectional view taken along the line 9—9 of FIG. 2.

The frame of the door 22 also includes upper and lower horizontal members 34 and 35, and is provided with intermediate members 36. As best shown in FIGS. 3 and 9, the upper member 34 and the lower member 35 are similar in cross-section to end members 24, having generally T-shaped outer recesses comprising elongated slots 42 and third recesses 37, access slots 42 being defined by outer edge wall portions 41. Each of the members 34 and 35 also include a front side wall 39 and a rear side wall 40. The upper and lower members 34 and 35 also include internally extending second outer, intermediate and inner transverse walls 43, 44, and 45 which are integrally formed with the front and rear walls 39 and 40. Similar to the configuration of the recesses 32 of the structure shown in FIG. 4, the upper and lower members 34 and 35 are also provided with adjacent fourth recesses or guideways 38 which are in registry with the recesses or guideways 32.

Figure 7:
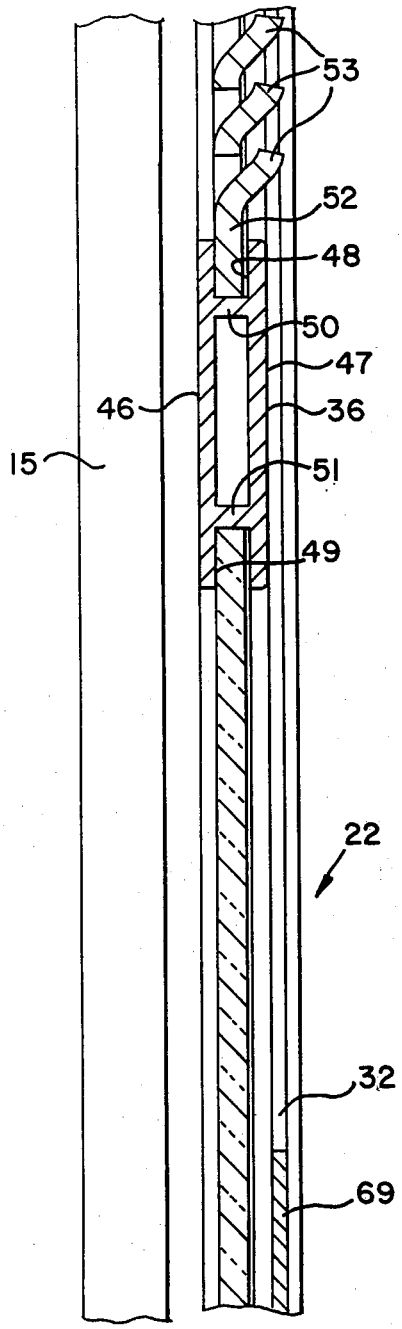
FIG. 7 is a cross-sectional view taken along the line 7—7 of FIG. 2.
Figure 8:
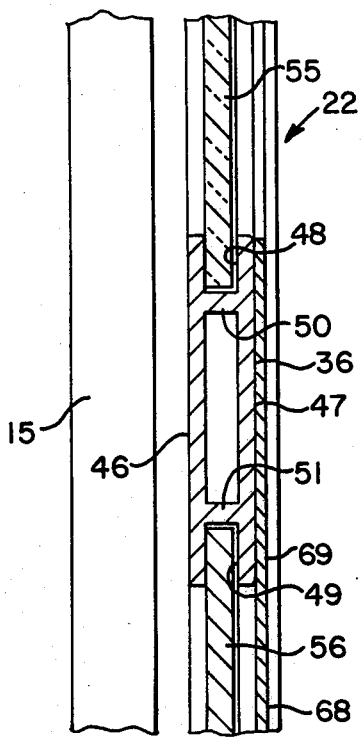
FIG. 8 is a cross-sectional view taken along the line 8—8 of FIG. 2.

As best shown in FIGS. 7 and 8, the intermediate members 36 also include a front wall 46 and a rear wall 47. The members 36 include an upper fifth recess 48 and a lower sixth recess 49, the rear wall 47 being spaced adjacent to or inwardly of the narrower of the recesses 38 of members 34 and 35. Each of the members 36 also includes a pair of internally extending second transverse walls 50 and 51, formed during fabrication by extrusion.

As shown in FIG. 3, an upper vent panel 52 including louvers 53 is positioned in one of the recesses 38, the same panel being also disposed in the second recesses 32 of the end members 24. The lower end of the panel 52 is also disposed in the fifth recess 48 as shown in FIG. 7. As shown in FIG. 7, transparent panel 55 is disposed within the sixth recess 49, within the vertical second recesses 32 and has its lower end disposed in the fifth recess 48 as shown in FIG. 8. A solid panel 56 has its upper end disposed in the recess 49 as shown in FIG. 8, is contained at its sides within the recesses 32 of the end members 24, and has its lower end disposed in one of the recesses 38 of the lower member 40, as best shown in FIG. 9. As shown in FIGS. 4, 5, and 6, the end members 24 include both broad and narrow adjacent second recesses 32. As shown in FIGS. 3 and 9, the upper and lower horizontal members 34 and 35 include broad and narrow adjacent fourth recesses 38, the narrow recesses 32 and 38 being in alignment. The narrow recesses 32 and 38 support, for sliding relation, a solid panel type shade 69 which may be moved from the position shown in FIG. 2 upwardly, thereby covering the transparent panel 55 as desired. Thus, the narrow recesses 32 provide a tracking means for the movement of the panel shade 68, which can be moved to cover transparent panel 55 or can be lowered as desired.

As best shown in FIG. 5, each door 22 is also provided with cavities 57 opening outwardly on the opposite sides thereof. The cavities 57 contain dish-shaped hand hold members 58 which may be utilized by the passenger to gain access into the compartment by sliding the door as desired.

As best shown in FIG. 3, T-shaped brackets 60 are positioned within the recess 37 of upper horizontal member 34 and include hanger members 59 to which rollers 61 are secured. The rollers 61 are slidingly movable within a track 62 suitably supported on the header 23. Thus the sliding door is suspended for sliding movement on the track 62. As shown in FIG. 9, recess 37 of lower member 35 is positioned over a suitable, inverted T-shaped guide member 68 to guide the door 22 as it moves.

As best shown in FIG. 4, complimentary-shaped rubber nose strips 63 include T-shaped projections 64 which are held captive within the first recesses 31. Since strips 63 may be secured without the utilization of additional fasteners, they provide for an effective and quickly assembled construction.

As shown in FIG. 2, the end members 24 are connected to the upper and lower members 34 and 35 by means of screws 65 which extend through the walls 27 of members 24 and are screwed into a suitable plate 66 secured to the ends of upper and lower members 34 and 35. In order to gain access to the screws 65, aligned openings 67 are provided in the walls 28 and 29 of members 24 to permit the insertion of a suitable screwdriver so that the screws can readily be removed if it is desired to replace any of the panels of the door.

The intermediate members 36 also may be similarly attached by means of screws to the end members 24, and thus by merely disassembling certain of the screws, efficient repair or replacement of door parts is facilitated. The door can be easily moved from the position shown in FIG. 1 into the space 21 provided, thereby providing access to and from the passanger compartment. A light and yet strong construction is provided which allows maximum use of compartment space. The extruded frame and the simple connection of parts using screws facilitates ease of repair or replacement of door parts.

What is claimed is:

1. A door frame structure for a railway passenger car having interconnected upper and lower and vertical end members of identical design each comprising front and rear side walls and internally extending outer, intermediate and inner transverse walls integrally interconnecting said side walls and defining a pair of side by side arranged hollow box sections, each of said side walls having outer edge portions in spaced relation which define a T-shaped recess including an access slot for admitting in the upper and lower members associated guides and in the end members complimentary-shaped nose strips.

2. The invention in accordance with claim 1, one of said vertical end members including cavities on said front and rear walls, laterally spaced to support hand holds for said door structure.

3. The invention in accordance with claim 2, said hand holds including dish shaped members recessed within said cavities.

4. The invention in accordance with claim 1, said side walls and an additional strip on said inner transverse wall defining guideways for associated panels therein.

5. The invention in accordance with claim 4, and a plurality of panels disposed within said guideways.

6. The invention in accordance with claim 1, and said upper, lower and end members consisting of extruded materials.

7. The invention in accordance with claim 1, and comprising removable fasteners connecting said upper and lower members to said end members.

8. The invention in accordance with claim 1, and including a pair of roller and hanger members connected within said T-shaped recess of said upper member, and a horizontal track supported in said railway car above said door frame structure slidably supporting said rollers and door structure thereon.

9. The invention in accordance with claim 1, and said T-shaped recess of said vertical end members including resilient complimentary-shaped nose members connected therein and projecting outwardly relative to said end members.

10. The invention in accordance with claim 1, and including a guide member supported by said car beneath said door structure including a vertical guide element projecting upwardly and extending into said T-shaped recess of said lower member.

11. The invention in accordance with claim 1, and including a plurality of intermediate members vertically spaced between said upper and lower members and extending between and connected to said end members.

12. The invention in accordance with claim 11, and said intermediate members consisting of extruded materials.

13. The invention in accordance with claim 11, and including removable fasteners connecting said intermediate members to said end members.

* * * * *